United States Patent [19]

Sugiura

[11] Patent Number: 4,666,373

[45] Date of Patent: May 19, 1987

[54] IMPELLER FOR ROTARY FLUID MACHINE

[76] Inventor: Eiichi Sugiura, 149, Matsumotocho, Hekinan-shi, Aichi, Japan

[21] Appl. No.: 840,664

[22] Filed: Mar. 18, 1986

[51] Int. Cl.[4] ..... F04D 29/22

[52] U.S. Cl. ..... 416/185; 416/186 R; 416/187; 415/213 R

[58] Field of Search ..... 416/186 R, 185, 182, 416/DIG. 2, 187; 415/213 R

[56] References Cited

U.S. PATENT DOCUMENTS

| | | | |
|---|---|---|---|
| 1,603,076 | 10/1926 | Hanson | 415/130 |
| 1,953,064 | 4/1934 | Dowson | 416/186 R |
| 2,165,808 | 7/1939 | Murphy | 416/186 R |
| 2,547,786 | 4/1951 | Seinfeld | 416/182 |
| 2,767,906 | 10/1956 | Doyle | 416/186 R |
| 3,159,106 | 12/1964 | Schumbacker et al. | 416/186 R |
| 3,477,384 | 11/1969 | Hlinka | 416/186 R X |
| 3,478,691 | 11/1969 | Henry | 416/186 R X |
| 3,746,467 | 7/1973 | Buse | 416/186 R |
| 3,788,765 | 1/1974 | Rusak | 415/213 R |
| 4,253,798 | 3/1981 | Sugiura | 416/186 R |

FOREIGN PATENT DOCUMENTS

| | | | |
|---|---|---|---|
| 1097276 | 7/1955 | France | 416/182 |
| 550150 | 5/1958 | Italy | 416/186 R |
| 300340 | 9/1965 | Netherlands | 416/185 |
| 123877 | 1/1949 | Sweden | 416/185 |
| 419544 | 11/1934 | United Kingdom | 416/185 |

*Primary Examiner*—Everette A. Powell, Jr.

*Attorney, Agent, or Firm*—Bruce L. Adams; Robert E. Burns; Emmanuel J. Lobato

[57] ABSTRACT

An impeller for a rotary fluid machine of the centrifugal type is disclosed which is adapted to be constructed as a liquid pump or gas compressor. The impeller comprises a disc having a boss which is fitted on a drive shaft, and a plurality of blades which are uniformly spaced apart circumferentially and axially project from at least one side of the disc. Each blade has a front and a rear surface, and a fluid path is defined between the front surface of a blade and the rear surface of an adjacent blade. The fluid path is arranged to extend from around the boss to the outer periphery of the disc. The width of the fluid path decreases gradually from around the boss toward the outer periphery of the disc, but the fluid path has a constant depth. The front and the rear surface of each blade are substantially arranged along circular arcs having different radii of curvature which are struck from a common center point. Center points associated with different blades are disposed on a single imaginary circle which is concentric with the disc.

12 Claims, 3 Drawing Figures

IMPELLER FOR ROTARY FLUID MACHINE

FIELD OF THE INVENTION

The invention relates to a rotary fluid machine of the centrifugal type which is used as a liquid pump or gas compressor, and more particularly, to the construction of an impeller for such a rotary fluid machine.

DESCRIPTION OF THE PRIOR ART

A gas such as air is called a compressible fluid while a liquid such as water is called an incompressible fluid. A compressor is used for the compressible fluid while a pump is used for the incompressible fluid in order to provide an increased fluid pressure. Both the pump and the compressor are operated based on the same principle in respect of imparting velocity energy to the fluid and converting the velocity energy into pressure energy. However, because of the difference between the compressible and the incompressible fluid, the actual constructions of the pump and compressor are slightly different from each other. A compressor has an increased number of blades in its impeller as compared with a pump, and the impeller at the compressor undergoes a number of revolutions such as 5,000 rpm, for example, which is substantially higher than the number of revolutions of the pump. A structural strength is required for the impeller which rotates at high speed in order to protect the same from mechanical destruction which may be caused by high peripheral speeds and high centrifugal forces.

In the discipline of pump engineering, the traditional theory of an impeller which is used in a centrifugal pump requires that a fluid path between adjacent blades of the impeller has a width which increases from the inlet, located at the center of the impeller, toward an outlet which is located along the outer periphery of the impeller. Similarly, an impeller for a compressor is formed with a fluid path having a width which increases from the inlet toward the outlet. However, the irrationality of such impeller configuration, which has been traditionally relied upon, has been pointed out by the advent of a new design as disclosed in U.S. Pat. No. 4,253,798 issued to the present inventor. In the impeller of the new design, the fluid path has a width which gradually decreases from the inlet toward the outlet, in a manner opposite to the conventional impeller, with the fluid path having a constant depth. A pump which incorporates the improved impeller has demonstrated a lift and an efficiency which far excel those of a conventional pump.

It has been of a great concern to the present inventor whether the improved impeller of the new design can be applied to a compressor, based on the same principle as in a pump. Recently, several experiments have been conducted with favorable results. As a result of these experiments, it is found that the improved impeller when applied to a compressor achieves an excellent result in quite the same manner as in the pump. While the usefulness in the response has been demonstrated during short-term experiments, it is found that a compressor incorporating the improved impeller is subject to mechanical destruction during its use over a prolonged period of time. However, it has been a relatively simple matter to locate the cause of such mechanical, destruction. Specifically, the improved impeller which has been used in the experiments has been manufactured as disclosed in the U.S. Patent cited above, with the front surface of each blade having a radius of curvature which is less than the radius of curvature of the rear surface of an adjacent blade, and with the center of radius of curvature of the front surface being located more remotely with respect to the center of the impeller than the center of radius of curvature of the rear surface. As a result, while the width of the fluid path decreases from the inlet toward the outlet, each blade has a thickness which increases from the center of the impeller toward the outer periphery thereof. As a result, during rotation at high speed, the mechanical stress at the outer periphery of the impeller increases to an extent which are not negligible.

OBJECTS OF THE INVENTION

It is an object of the invention to provide an impeller for a rotary fluid machine which can be used in a gas compressor as well as a liquid pump.

It is a specific object of the invention to provide an impeller for centrifugal fluid machine which can be designed according to the theory proposed by the present inventor and which is further modified to exhibit an increased resistance to mechanical failure during rotation at high speeds.

It is another object of the invention to provide an impeller for rotary fluid machine which has a reduced size and weight and which can be manufactured in a simple manner.

SUMMARY OF THE INVENTION

It is a feature of the invention that a front and a rear surface of each blade are arranged so as to be substantially disposed along circular segments or arcs having different radii of curvature which are struck from a common center point, and each center point is located at an equal distance along a single imaginary circumference, the center of which is aligned with the center of the impeller. When such requirements are satisfied, a fluid path formed between the front surface of one blade and the rear surface of an adjacent blade has a width which gradually decreases from an inlet located at the center portion of the impeller toward an outlet which is located at the outer periphery of the impeller, thus enjoying the theory for an improved impeller proposed by the present inventor. On the other hand, each blade has a constant thickness between the center and the outer periphery of the impeller, thus achieving a good balance of weight while reducing the overall weight. Concentration of mechanical stresses around the outer periphery of the impeller is avoided, whereby the impeller is applicable to a gas compressor which requires a rotation at high speeds. The impeller having blades of uniform thickness is formed of a metal or a synthetic resin as in the pror art. In such instance, metal blades of uniform thickness may be secured to the disc of the impeller by welding. It is also possible to manufacture the impeller by a casting operation, a molding operation or a machining operation in a facilitated manner.

When the improved impeller is incorporated into an existing fluid machine, the fluid machne may require a slight modification in the design thereof. However, the relation between major parameters and the characteristics remain the same as in the prior art, as indicated below, and hence any modification can be empirically determined.

Diameter of impeller: discharge pressure, discharge flow and peripheral speed

Eye diameter: cavitation

Exit angle: discharge pressure and efficiency

Number of fluid paths: discharge flow and discharge pressure

Cross-sectional area of fluid paths: discharge flow

DESCRIPTION OF PREFERRED EMBODIMENT

Figure 1:
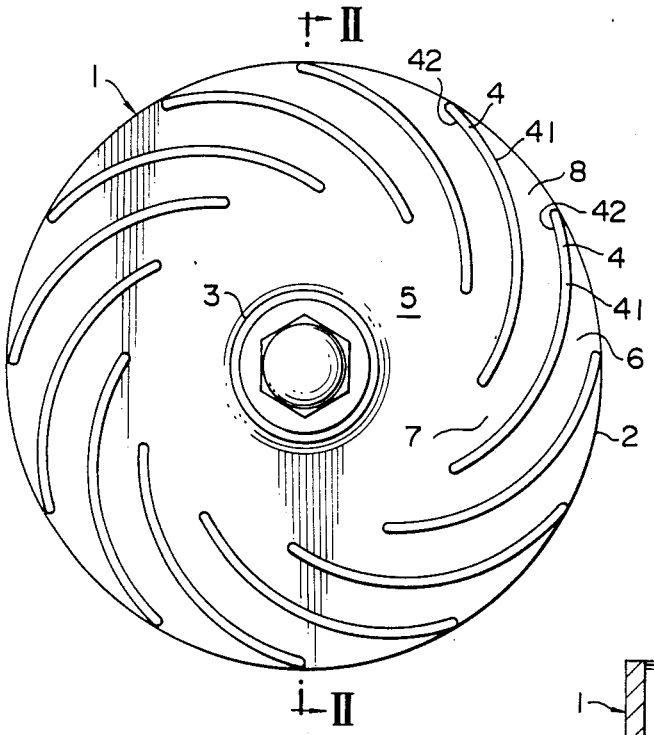
FIG. 1 is a front view of an impeller for fluid machine constructed according to the invention.
Figure 2:
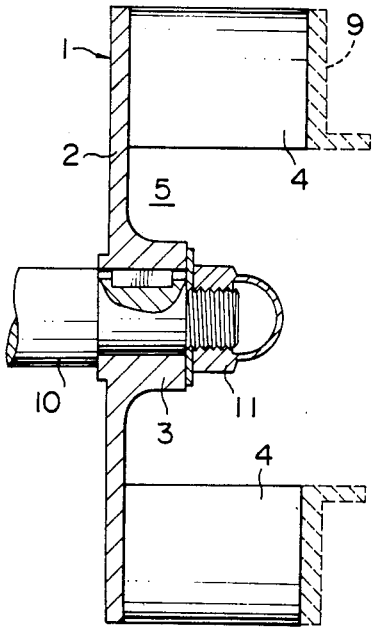
FIG. 2 is a cross section taken along the line II—II shown in FIG. 1.

Referring to FIGS. 1 and 2, there is shown an embodiment of an impeller according to the invention. Specifically, an impeller 1 comprises a disc 2 having a boss 3, and a plurality of blades 4 which are equi-distantly spaced apart circumferentially, arranged outwardly or radially from around the center of the disc toward the periphery of the disc, and project axially from one side of the disc 2. The embodiment shown is of a single suction type in which the blades 4 are disposed on one side of the disc 2, but it should be understood that the invention is applicable to an impeller of double suction type in which the blades are disposed on the opposite sides of the disc. Each blade 4 is formed of a sheet of metal such as steel, for example, having a uniform thickness and which is curved according to a predetermined radius of curvature. The blades are firmly secured to predetermined locations on one side of the disc 2 by welding. One end of each blade 4 is spaced by a given distance from the boss 3 in order to define an eye 5 around the boss 3 while the other end reaches the peripheral edge of the disc 2. A fluid path 6 is defined between a front surface 41 of one blade 4 and a rear surface 42 of an adjacent blade 4. The fluid path 6 has an inlet 7 which communicates with the eye 5 while an outlet 8 opens at the outer periphery of the disc 2. Each fluid path 6 has an constant depth. In other words, the height of each blade 4 relative to the disc 2 remains constant. However, the fluid path 6 is formed so that its width decreases gradually from the inlet 7 toward the outlet 8. The difference in the width between the inlet 7 and the outlet 8 may be minimal. The embodiment is illustrated as an open impeller having an open top for each fluid path 6. However, a closed impeller may also be constructed by providing an annular top plate 9 as indicated in dotted lines in FIGS. 2. The boss 3 of the impeller 1 is mounted on a drive shaft 10 in a known manner, and is firmly secured by a clamping nut 11.

Figure 3:
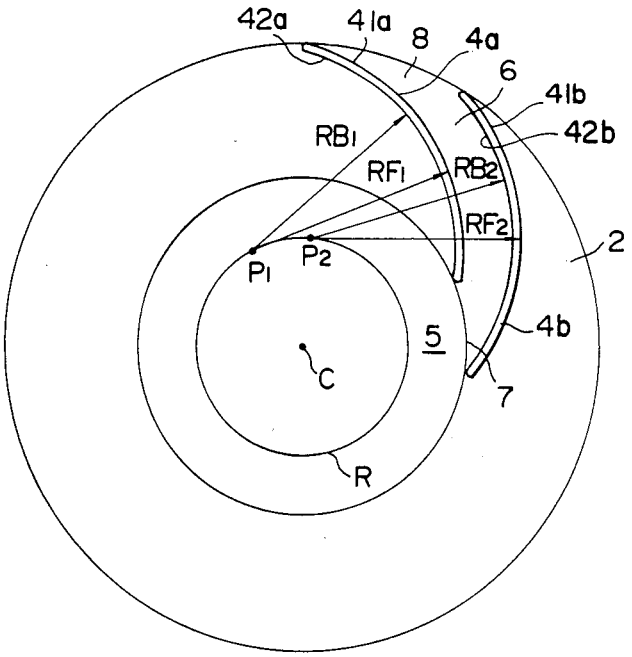
FIG. 3 is an illustration of positioning of blades in the impeller shown in FIG. 1.

FIG. 3 illustrates the positioning of the blades 4 of the impeller 1 illustrated in FIG. 1. Again, similar parts are designated by corresponding numerals as in FIG. 2. It will be seen that the front surface 41 and the rear surface 42 of each blade 4 are disposed along circular arcs having different radii of curvature RF and RB which are struck from a common center point P, thus defining the fluid path 6 between the front surface 41 of one blade 4 and the rear surface 42 of an adjacent blade 4. More specifically, a front surface 41*a* and a rear surface 42*a* of one blade 4*a* are disposed along arcs having radii RF1 and RB1 which are struck from a common center point P1 while a front surface 41*b* and a rear surface 42*b* of a blade 4*b* which is located adjacent to the blade 4*a* are disposed along arcs having different radii RF2 and RB2 which are struck from a common center point P2 which is offset from the previously mentioned center point P1. The individual center points P1 and P2 are disposed at an equal interval along a single imaginary circle R having a center which coincides with the center C of the disc 2.

With the described arrangement, the fluid path 6 defined between adjacent blades have a width which tends to decrease gradually from the inlet 7 toward the outlet 8. The width of the fluid path 6 can be considered as representing the diameter of an imaginary largest ball which can be closely received within the path. In this respect, the principle of operation of the impeller 1 remains the same as disclosed in U.S. Patent cited above, and therefore will not be repeated. In accordance with the invention, however, each blade 4 has a constant curvature and a constant thickness which remains unchanged from a region around the center of the impeller to a region remote therefrom, thus achieving a good balance of weight around the disc 2. This avoids concentration of mechanical stresses in the region of the outer periphery of the impeller during its rotation at high speeds, thus enabling the impeller to be used in a gas compressor as well as in a liquid pump.

What is claimed is:

1. In an impeller for a rotary fluid machine including a disc having a boss fitted on a drive shaft, a plurality of blades disposed radially at a equal spacing with each other and projecting axially from at least one side of the disc, each blade having a front and a rear surface, and a plurality of fluid paths each defined between the front surface of a blade and the rear surface of an adjacent blade, the fluid paths extending from around the boss to the outer periphery of the disc, each fluid path having a width which gradually decreases from adjacent to the boss toward the outer periphery of the disc and also having a constant depth;

the improvement comprising the front and rear surface of each blade being substantially disposed along arcs having different radii of curvature which are struck from a common center point, the individual center points being disposed along a single imaginary circle which is concentric with the center of the disc.

2. A liquid pump having the impeller defined in claim 1.

3. A gas compressor having the impeller defined in claim 1.

4. An impeller according to claim 1 in which each blade is composed of a metal sheet having a uniform thickness, the metal sheet being secured to the disc by welding.

5. An impeller for a rotary fluid machine comprising: a disc rotationally driven during use of the impeller around a center axis thereof; a plurality of blades disposed equidistantly with each other on the disc and extending outwardly from around the center of the disc to the periphery of the disc to define a plurality of fluid paths between adjacent blades, the fluid paths having inlets opening around the center of the disc and outlets opening at the periphery of the disc, each blade projecting axially from the disc and having opposed front and rear surfaces spaced in section in segmented concentric circles of different radii so that each blade has a circular shape and a uniform thickness, respective centers of the segmented concentric circles of the plurality of blades being arranged at an equal interval along an imaginary circle concentric to the disc so that the respective fluid paths provide a varying width decreasing from the inlet toward the outlet.

6. An impeller according to claim 5; wherein each blade is composed of a metal sheet having a uniform thickness.

7. An impeller according to claim 5; wherein the metal sheet is secured to the disc by welding.

8. An impeller according to claim 6; wherein the metal sheet is composed of steel.

9. An impeller according to claim 5; wherein the blades comprised cast blades.

10. An impeller according to claim 5; wherein the blades comprised molded blades.

11. An impeller according to claim 5; wherein the fluid paths have a uniform thickness.

12. An impeller according to claim 5; including an annular top plate for covering the fluid paths.

* * * * *